US009672982B2

(12) United States Patent
Yoo

(10) Patent No.: US 9,672,982 B2
(45) Date of Patent: Jun. 6, 2017

(54) PRODUCTION METHOD FOR A FIGURE-OF-EIGHT-SHAPED LAMINATED COIL

(75) Inventor: Bong-Gi Yoo, Incheon (KR)

(73) Assignee: CHANG SUNG CO., Chungcheongbuk-do (KR)

( * ) Notice: Subject to any disclaimer, the term of this patent is extended or adjusted under 35 U.S.C. 154(b) by 232 days.

(21) Appl. No.: 14/117,420

(22) PCT Filed: May 17, 2012

(86) PCT No.: PCT/KR2012/003919

§ 371 (c)(1),
(2), (4) Date: Nov. 13, 2013

(87) PCT Pub. No.: WO2012/157988

PCT Pub. Date: Nov. 22, 2012

(65) Prior Publication Data

US 2014/0237807 A1 Aug. 28, 2014

(30) Foreign Application Priority Data

May 19, 2011 (KR) ..... 10-2011-0047209

(51) Int. Cl.
*H01F 41/061* (2016.01)
*H01F 41/082* (2016.01)
(Continued)

(52) U.S. Cl.
CPC ..... *H01F 41/061* (2016.01); *H01F 27/2847* (2013.01); *H01F 27/2852* (2013.01);
(Continued)

(58) Field of Classification Search
CPC ..... H01F 27/2847; H01F 27/2852; H01F 2027/2857; H01F 2027/2861;
(Continued)

(56) References Cited

U.S. PATENT DOCUMENTS

2005/0204546 A1* 9/2005 Lin ..... H01F 2027/2861
2009/0144967 A1 6/2009 Hasu et al.

FOREIGN PATENT DOCUMENTS

JP S58-044703 A 3/1986
JP 10-172852 6/1998
(Continued)

OTHER PUBLICATIONS

Machine Language Translation (English) of Japanese Patent Publication, JP 2007-305803, Sep. 2015.*
(Continued)

*Primary Examiner* — A. Dexter Tugbang
(74) *Attorney, Agent, or Firm* — Dority & Manning, P.A.

(57) ABSTRACT

There is provided a production method for a laminated coil, the production method including: a process of producing a coil part of one axis by stacking a flat coil in an axial direction, a process of bending the flat coil of a connection portion in an extended state thereof in a length direction to allow for the division of a first coil part and a second coil part, wherein the connection portion connecting two coil parts is produced by bending the flat coil of the connection portion, and a process of finally spreading the bent connection portion, such that the first coil part and the second coil part may be disposed to be parallel in the same direction on the same plane.

4 Claims, 5 Drawing Sheets

(51) Int. Cl.
*H01F 27/28* (2006.01)
*H01F 41/074* (2016.01)
*H01F 41/064* (2016.01)

(52) U.S. Cl.
CPC ..... *H01F 41/064* (2016.01); *H01F 41/074* (2016.01); *H01F 41/082* (2016.01); *H01F 2027/2857* (2013.01); *H01F 2027/2861* (2013.01); *Y10T 29/4902* (2015.01); *Y10T 29/49071* (2015.01); *Y10T 29/49073* (2015.01); *Y10T 29/49201* (2015.01)

(58) Field of Classification Search
CPC ..... H01F 41/0604; H01F 41/0612; H01F 41/0638; H01F 41/0658; H01F 41/061; H01F 41/064; H01F 41/074; H01F 41/082; Y10T 29/4902; Y10T 29/49071; Y10T 29/49073; Y10T 29/49201
See application file for complete search history.

(56) References Cited

FOREIGN PATENT DOCUMENTS

| | | | |
|---|---|---|---|
| JP | 2001-093767 A | | 4/2001 |
| JP | 2004-055920 | | 2/2004 |
| JP | 2005-057113 | | 3/2005 |
| JP | 2007-305803 | | 11/2007 |
| JP | 2007305803 A | * | 11/2007 |
| JP | 2008-186980 | | 8/2008 |
| JP | 2010010484 A | * | 1/2010 |
| JP | 2010-206029 | | 9/2010 |
| JP | 2010-219252 | | 9/2010 |
| JP | 2011010528 A | * | 1/2011 |

OTHER PUBLICATIONS

Machine Language Translation (English) of Japanese Patent Publication, JP 2010-10484, Jul. 2016.*
PCT/KR2012/003919 International Search Report, Dated Oct. 31, 2014.
European Application No. 12786508.7, International Search Report, Dated Oct. 31, 2014.
Japanese Office Action dated Feb. 24, 2015, Issued in the corresponding Japanese Patent Application No. 2014-511302.(2 Pages).
PCT/KR2012/003919 International Search Report, Dated Nov. 21, 2012.
PCT/KR2012/003919 PCT Notification International Reflecting Filing Date May 17, 2012 and Priority Date of May 19, 2011.

* cited by examiner

PRODUCTION METHOD FOR A FIGURE-OF-EIGHT-SHAPED LAMINATED COIL

TECHNICAL FIELD

The present invention relates to a production method for a laminated coil having a first coil part and a second coil part formed by bending a flat coil.

BACKGROUND ART

In general, a reactor includes a coil and a magnetic core and forms inductance by bending the coil around the magnetic core. According to the related art, reactors are used in boosting circuits, inverter circuits, active filter circuits and the like. In particular, in reactors used in boosting circuits for vehicles, in order to obtain a high degree of inductance in a high current region, two coils are commonly connected in parallel such that current flowing in the coils flows in a forward direction. However, since may be difficult to consecutively produce the first coil part and the second coil part, the first coil part and the second coil part may be separately produced and subsequently connected to each other by a method such as a soldering method or the like. Since such a production method requires two types of coil part and needs to include a connection process using soldering or the like, a process for insulation processing in a connection portion, a process for inspecting electrical characteristics in the associated connection portion, a process for inspecting electrical insulating characteristics, and the like, the number of production processes may be increased, mass productivity may be deteriorated and at the same time, costs required therefor may be increased. In addition, a product produced by the method described above has a connection portion and further, the connection portion is disposed outwardly of the coil, which may deteriorate performance of the product such as degrading reliability, generating quality deviations, and the like.

Alternatively, a method of consecutively forming the first coil part and the second coil part without a connection process such as soldering or the like, but in which the second coil part is bent at an angle of 180° with respect to the first coil part to form a bent connection portion exists. However, stress concentration may be disadvantageously generated in the bent connection portion produced by this method.

Alternatively, a method of forming first and second coil parts such that a bent portion formed by bending a single flat coil from respective ends thereof in a length direction is stacked in an angular tube shape exists. However, the coil formation method further requires a length measuring process for measuring a length of a connection portion immediately before the completion of a second coil after a first coil has been completed while the first coil is formed before the formation of the second coil, a length dividing process for dividing the measured length of the connection portion into a length thereof for a preset interval between both coils and a length thereof for adjusting the flat coil set in the second coil, and a final bending process for installing an offset portion in one side of an edge of the bent portion in the second coil so as to correspond to the divided length, and simultaneously, setting the interval between the both coils. Consequently, since the coil formation method includes a large number or processes and particularly, further includes a process for measuring a length of the remaining wire in a manufacturing process of a connection coil, it may be disadvantageous in terms of efficiency and costs in a manufacturing method.

DISCLOSURE

Technical Problem

An aspect of the present invention provides a production method for a laminated coil, capable of consecutively producing coil parts using a single flat coil during the production of the coil to thereby allow for a simplified coil production process as compared to the case of a production method according to the related art, a reduction in producing costs, improvements in product reliability, and securement in a predetermined performance.

Technical Solution

According to an aspect of the present invention, there is provided a production method for a laminated coil, the production method including bending a single flat coil from an initiation point thereof, spaced apart from a first end thereof in one direction, to form a first coil part having the flat coil stacked in an angular tube shape; forming a connection portion in a stacking direction by bending the flat coil of the first coil part; bending the flat coil of the connection portion in an extended state thereof in a length direction and stacking the flat coil in an angular tube shape to form a second coil part; and spreading the bent connection portion such that the first coil part and the second coil part are disposed in parallel in the same direction on the same plane.

Moreover, in a first example of the present invention, in the forming of the connection portion, a first bent portion of the connection portion may be bent in a direction perpendicular to the length direction of the flat coil.

Furthermore, in a second example of the present invention, in the forming of the connection portion, the flat coil may be bent in a direction perpendicular to the length direction thereof such that a first bent portion of the connection portion is aligned with the stacking direction of the flat coil, and a second bent portion of the connection portion may be re-bent.

Advantageous Effects

According to embodiments of the present invention, a first coil part and a second coil part may be consecutively produced in a coil production process, such that an additional connection process such as soldering or the like may be unnecessary in a connection portion between the first coil part and the second coil part. A process for bending the connection portion may be additionally included in the coil production process, such that the connection portion may be finally disposed on the same plane without being bent. In addition, a process for measuring a length of the remaining wire in the connection portion may not be required in the coil production process, whereby the number of production processes may be significantly reduced.

In addition, a reduction, in costs required at the time of production, improvements in product reliability, and securement in a predetermined performance may be achieved.

[Representative Figure]

FIG. 3

BEST MODE

Hereinafter, the present invention relates to a production method for a laminated coil. Hereinafter, embodiments of the present invention will be described in detail with reference to the accompanying drawings.

Figure 1A:
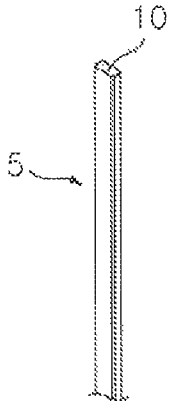
FIG. 1 is a view illustrating a process of preparing a flat coil before the bending thereof.
FIG. 1*b* is a view illustrating a process of bending the flat coil from an end thereof in one direction.
FIG. 1*c* is a view illustrating a process of forming a first coil part having the flat coil stacked in an angular tube shape by the process.
FIG. 1*d* is a view illustrating a process of forming a first bent portion by bending the flat coil of the first coil part.
FIG. 1*e* is a view illustrating a first example of a process of forming a second coil part by stacking the flat coil in an angular tube shape.
FIG. 1*f* is a view illustrating a process of forming a second bent portion by re-bending the first bent portion of a connection portion, bent once.
FIG. 1*g* is a view illustrating a second example of a process of forming the second coil part by stacking the flat coil in an angular tube shape.
Figure 1B:
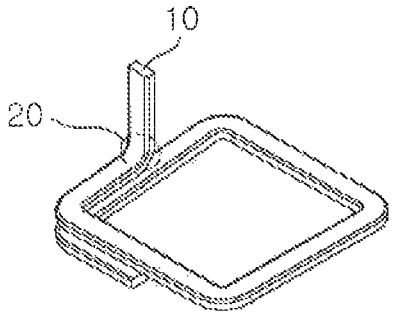
Figure 1C:
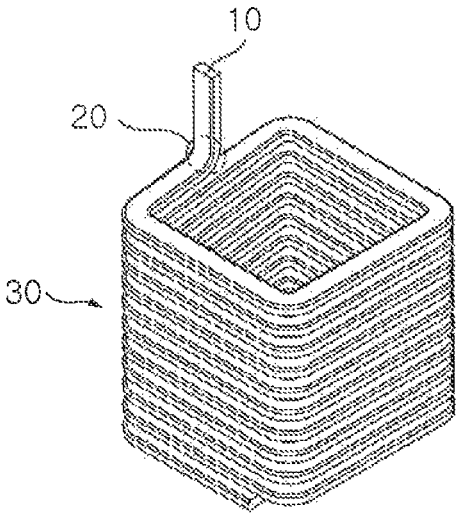
Figure 1D:
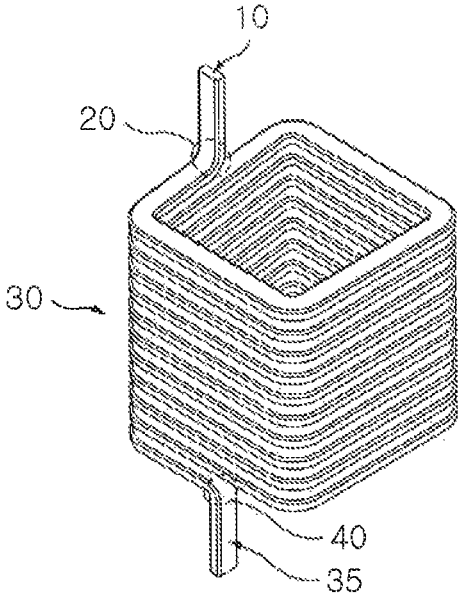
Figure 1E:
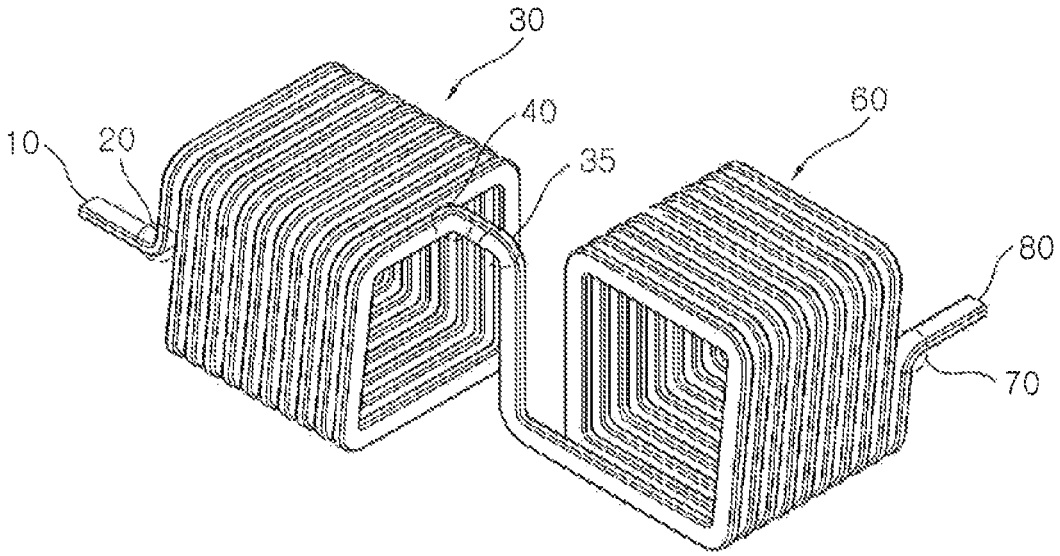
Figure 1F:
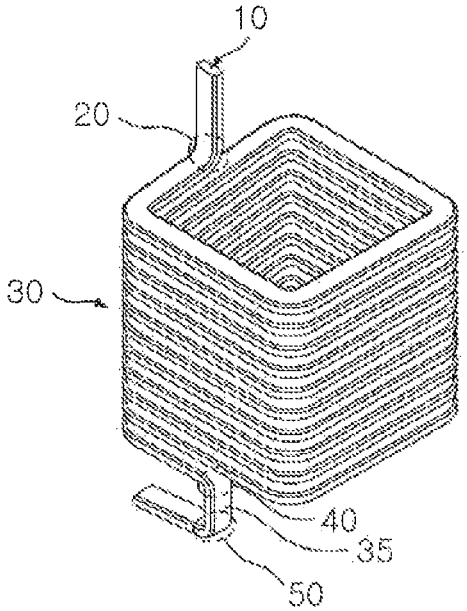
Figure 1G:
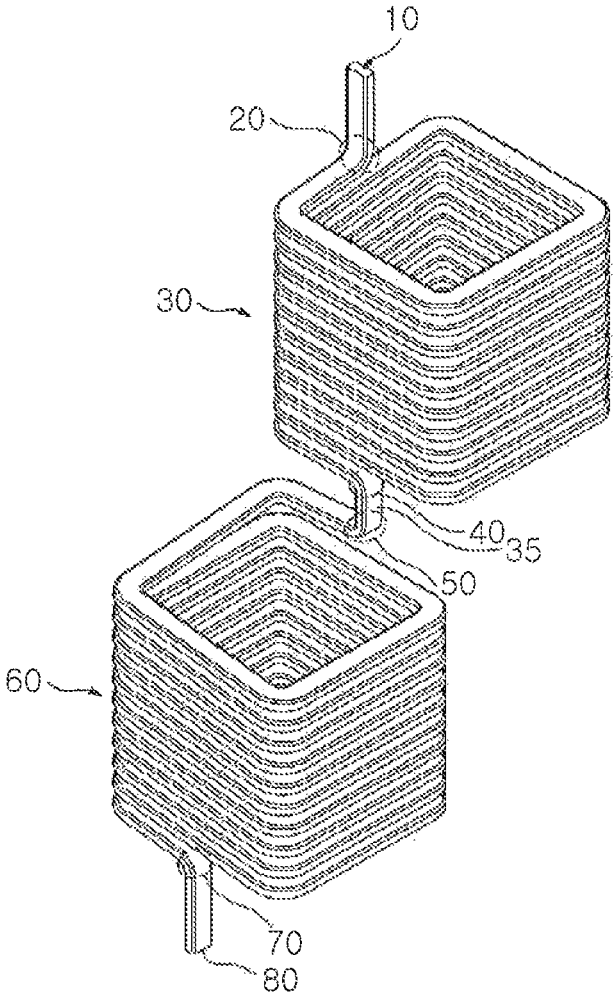

FIG. 1*a* is a view illustrating a process of preparing a flat coil before the bending thereof. FIG. 1*b* is a view illustrating a process of bending the flat coil from an end thereof in one direction. FIG. 1*c* is a view illustrating a process of forming a first coil part having the flat coil stacked in an angular tube shape by the process. FIG. 1*d* is a view illustrating a process of forming a first bent portion by bending the flat coil of the first coil part. FIG. 1*e* is a view illustrating a first example of a process of forming a second coil part by stacking the flat coil in an angular tube shape. FIG. 1*f* is a view illustrating a process of forming a second bent portion by re-bending the first bent portion of a connection portion, bent once. FIG. 1*g* is a view illustrating a second example of a process of forming the second coil part by stacking the flat coil in an angular tube shape.

Figure 2:
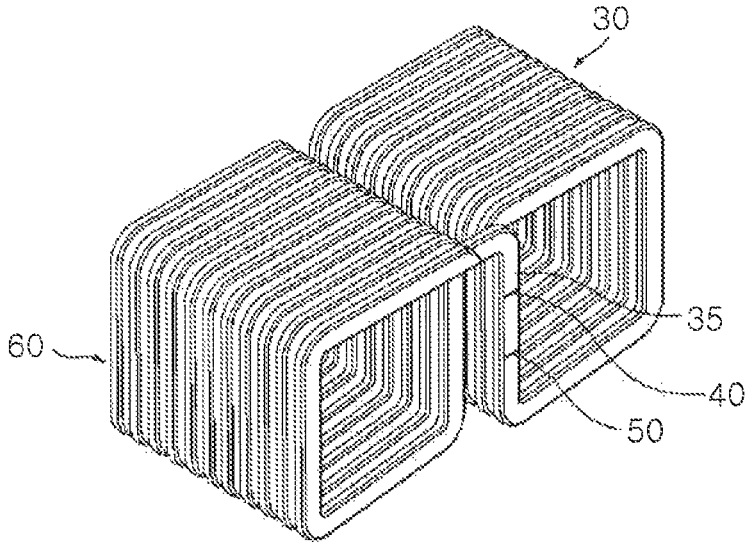
FIG. 2 is a view illustrating a process of spreading the bent connection portion such that the first coil part and the second coil part that are finally formed are disposed in parallel in the same direction on the same plane.
Figure 3:
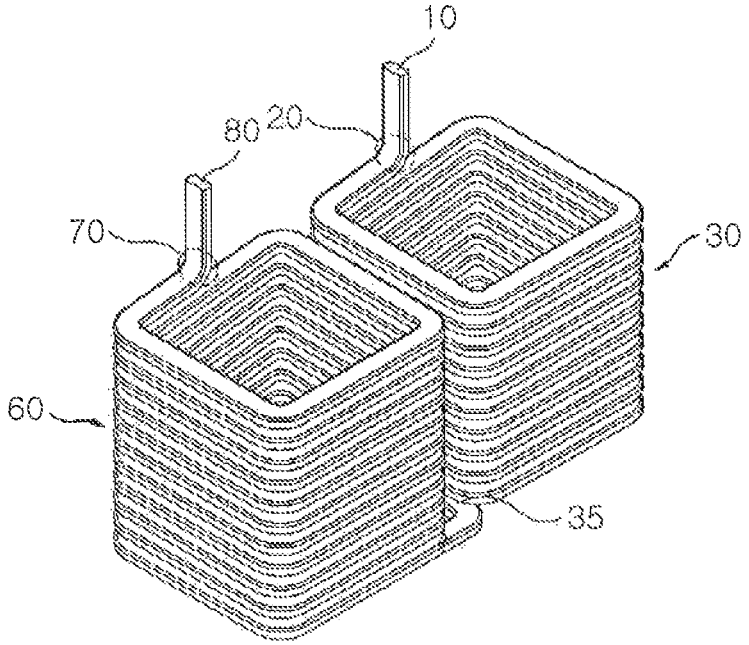
FIG. 3 is a view illustrating a laminated coil shown in FIG. 2 when viewed from above.

FIG. 2 is a view illustrating a process of spreading the bent connection portion such that the first coil part and the second coil part that are finally formed are disposed in parallel in the same direction on the same plane. FIG. 3 is a view illustrating a laminated coil shown in FIG. 2 when viewed from above.

In a first embodiment, as illustrated in FIG. 1*a*, a flat coil 5 having a first end 10 formed therein is prepared. As illustrated in FIG. 1*b*, the flat coil may be bent in an axial direction from an initiation point 20 thereof spaced apart from the first end 10 thereof. In this case, the term "bending" refers to forming a coil by bending a flat coil and is known as "edgewise winding". As illustrated in FIG. 1C, the flat coil is bent in the axial direction to form a first coil part 30 having the flat coil stacked in an angular tube shape.

As illustrated in FIG. 1*d*, in the correspondingly formed first coil part 30, the flat coil is bent from a first bent portion 40 to form a connection portion 35. As illustrated in FIG. 1*e*, the flat coil of the connection portion 35 is bent in an extended state thereof in a length direction to separate the first coil part 30 and a second coil part 60, and then the flat coil is stacked in an angular tube shape to form the second coil part 60.

An end 90 of the second coil part 60 may be formed in a position spaced apart from a termination point 70 of the second coil part 60 in which the stacking of the flat coil is terminated, by a determined distance.

In a second embodiment, the processes of FIGS. 1*a* through 1*d* are the same as those of the first embodiment described above, and as illustrated in FIG. 1*f*, the connection portion is re-bent in a position thereof spaced apart from the first bent portion 40 in the length direction of the flat coil to form a second bent portion 50. As illustrated in FIG. 1*g*, the flat coil is bent to form the second coil part 60 having the flat coil stacked in the angular tube shape.

The end 80 of the second coil part 60 may be formed in a position spaced apart from the termination point 70 of the second coil part 60 in which the stacking of the flat coil is terminated, by a determined distance.

In the coil produced according to the first example and the second example described above, the bent connection portion 35 may spread out such that the first coil part 30 and the second coil part 60 are disposed in parallel in the same direction on the same plane, as illustrated in FIG. 2, to form a finished product.

DESCRIPTION OF REFERENCE NUMERALS

5: flat coil
10: first end
20: initiation point
30: first coil part
35: connection portion
40: first bent portion
50: second bent portion
60: second coil part
70: termination point
80: second end

The invention claimed is:

1. A production method for a laminated coil, the production method comprising:

bending a single flat coil from an initiation point, spaced apart from a first end of the flat coil, in a stacking direction to form a first coil part having the flat coil stacked in an angular tube shape of the stacking direction;

forming a connection portion in the stacking direction of the first coil part by bending the flat coil of the first coil part;

bending the flat coil of the connection portion in an extended state of the connection portion, in a second stacking direction to form a second coil part stacked in another annular tube shape along the second stacking direction such that the second stacking direction of the second coil part is non-parallel to the stacking direction of the first coil part; and separating the first coil part and the second coil part at the connection portion that has been bent such that the first coil part and the second coil part are disposed on the same plane.

2. The production method of claim 1, wherein in the forming of the connection portion, the flat coil is bent in a direction perpendicular to the stacking direction to form a first bent portion and a second bent portion such that the first bent portion of the connection portion is aligned with the stacking direction of the first coil part.

3. The production method of claim 1, wherein in the forming of the connection portion, the flat coil is bent in a direction perpendicular to the stacking direction such that a first bent portion of the connection portion is aligned with the stacking direction of the first coil part, and a second bent portion of the connection portion is re-bent in the second stacking direction.

4. The production method of claim 1, wherein the connection portion is bent such that the second stacking direction of the second coil part is perpendicular to the stacking direction of the first coil part.

* * * * *